United States Patent [19]

Vanderheyden

[11] 3,943,540

[45] Mar. 9, 1976

[54] PHOTOGRAPHIC DEVELOPING APPARATUS

[75] Inventor: Robert Louis Marie Vanderheyden, Zonhoven, Belgium

[73] Assignee: Addressograph-Multigraph Corporation, Cleveland, Ohio

[22] Filed: Apr. 25, 1974

[21] Appl. No.: 464,092

[30] Foreign Application Priority Data

Apr. 24, 1974 Belgium ..... 814086

[52] U.S. Cl. ..... 354/318; 118/260; 427/428; 427/429

[51] Int. Cl.[2] ..... G03D 5/00

[58] Field of Search ..... 354/297, 300, 317, 318; 355/10; 352/130; 118/260, 268; 117/11 Z; 427/428, 429

[56] References Cited

UNITED STATES PATENTS

| | | | |
|---|---|---|---|
| 2,332,008 | 10/1943 | Paulsen | 118/260 X |
| 2,337,808 | 12/1943 | Ford | 118/268 |
| 2,732,824 | 1/1956 | Brown | 118/268 |
| 3,262,381 | 7/1966 | Zimmerman | 352/130 X |
| 3,413,954 | 12/1968 | Viola | 118/268 X |
| 3,424,074 | 1/1969 | Chen et al. | 354/317 |
| 3,626,833 | 12/1971 | Koch | 354/318 |
| 3,841,827 | 10/1974 | Thettu | 118/260 X |

FOREIGN PATENTS OR APPLICATIONS

| | | | |
|---|---|---|---|
| 798,388 | 7/1958 | United Kingdom | 117/112 |
| 988,577 | 10/1952 | France | 354/297 |

*Primary Examiner*—Fred L. Braun

[57] ABSTRACT

In a liquid supply system for a developing apparatus, a liquid absorbing wick construction which is formed of polyester fibers matted together to form a liquid absorbant pad which, when it is pressed against the surface of a rubber applicator roller, feeds and supplies liquid to the rubber roller surface. The fibers are formed from polyethylene terephthalate resins which are formed into a unitary pad by "needling" the fibers together and which is then enclosed either entirely or partially by a sheath so that the fibers are retained on the pad.

4 Claims, 2 Drawing Figures

PHOTOGRAPHIC DEVELOPING APPARATUS

BACKGROUND OF THE INVENTION

This invention relates generally to diazotype reproduction apparatus, and more particularly, to an improved wick-type applicator for feeding a supply of liquid to the applicator roller of the developer section of such a reproduction apparatus.

The reproduction apparatus involved in this invention is of the type that requires a controlled amount of liquid developing agent to be applied to the light-sensitive diazotype material. Such reproduction apparatus comprises a special applicator roller having a surface finish adapted to carry such controlled amounts of liquid thereon. The usual construction of such an apparatus requires the latent image-bearing diazotype material to be pressed against the roller surface thereby transferring the controlled amount of liquid in order to develop the azo dye image thereon. The metering of liquid is achieved by the use of a wiper blade for removing excess developing liquid from the surface of the roller, and a pressure device for pressing the sheet of paper against the roller to pick up the precise amount of fluid. While a wide range of constructions may be used for pressing the sheet against the applicator roller, one of the preferred techniques is the use of a pressure blade similar to the wiper blade.

One of the important aspects of the construction of such a developer device is the liquid supply system which applies an excess amount of liquid to the developer roller surface which ultimately is metered by the aforementioned wiper blade. The means known up to the present time for supplying such a developer liquid involved pumping the liquid from a reservoir to a manifold dispensing tube running parallel to the roller, and then collecting all excess liquid which flowed off the roller after passing through the metering step. Hence, a rather complex liquid channel and feed system was required. Such delivery systems which require the use of a pump are complicated to fabricate, and increase the cost of the equipment.

Another technique for applying the liquid to the surface of the roller is by partial immersion of a roller in a trough containing the liquid. Immersion systems suffer from the problem of exposing the liquid to the atmosphere and to contamination and evaporation. The immersion systems additionally suffer from the disadvantage of having to impart larger volumes of the developer liquid into the system and, hence, detract from the economics of the reproduction process.

The use of a material formed into an applicator wick soaked with the developer liquid has been known, but such wick constructions suffer from the deficiency of non-uniform delivery because of their particular fibrous structure and have been found to be rather fragile, giving up the fibrous materials of which they are made which become contaminants to the liquid and to the developing techniques by virtue of the fact that they become trapped in the metering devices and therefore cause uneven and streaked reproduction of the copies.

SUMMARY OF THE INVENTION

It is a general object of the present invention to provide an improved liquid delivery system to the applicator roller which overcomes the disadvantages of the heretofore known devices, and which is simple to fabricate, provides a uniform application of liquid to the light-sensitive paper, requiring a minimum source supply of liquid to be contained in the machine, and will withstand the abrasive forces.

It is a further object of the present invention to provide a wick-type applicator for the developer system of a diazotype machine which is simple to fabricate and insures the diffusion and continuous application of sufficient quantities of the liquid to the face of the applicator roller of the device.

It is a further specific object of the present invention to provide a wick-type dispenser made up of polyester fibers which are aggregated and compressed into an integrated core of a liquid supply pad.

It is a still further object of the present invention to provide a liquid supply pad made up of a core material comprising polyethylene glycol terephthalate fibers compressed into matted body and having a permeable protective sheath applied over said core, at least at the point thereof which is to come into contacting relationship with the applicator roller.

It is yet a still further detailed object of the present invention to provide a fluid delivery wick made up of a matted core comprising polyethylene glycol terephthalate fibers and a permeable protective sheath comprised of a fabric having properties substantially similar to velvet, as regards its coefficient of friction, porosity and permeability.

Other details and features of the invention will become apparent from the description hereinafter given of a specific embodiment, reference being had to the accompanying drawings; such description is intended to be exemplary of the invention and is not intended to limit its scope.

DESCRIPTION OF THE PREFERRED EMBODIMENTS

Figure 1:
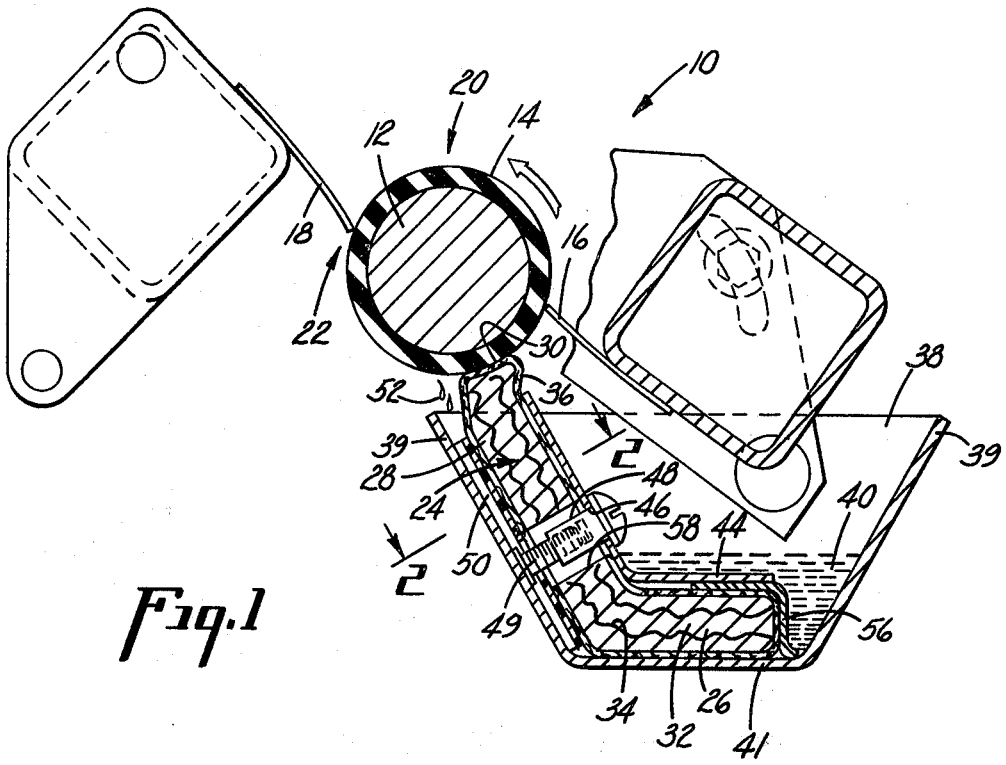
FIG. 1 is a diagrammatic cross-section of the fluid delivery system of the instant invention.

Referring to the drawings, there is shown the developer assembly identified with the general reference numeral 10 which comprises an applicator roller 12 having a specially finished surface 14 which renders it particularly suitable for carrying thereon a metered amount of developer liquid which is ultimately to be applied to the sensitized paper. In contact with the surface 14 are the wiper blade 16 and the pressure blade 18 which establishes a zone 20 on the surface 14. The zone 20 occurs after the roller passes under the influence of the wiper blade 16. The metered amount of liquid is delivered to the pressure blade 18 which is in pressure contact with the surface creating a developing zone 22. The developing zone 22 is the area of contact between the blade 18 and the surface 14.

Immediately in advance of the wiper blade, there is applied to the surface of the roller the fluid delivery wick construction 24 which is shown formed into a generally L shaped form having a base portion 26 and an upstanding leg portion 28, with the exposed end thereof forming the working face 30 which is in rubbing contact with the applicator roller 12. The fluid delivery wick 24 is comprised of a matted core 32 formed by compacting and compressing together fibers of a polyester resin so that it is capable of absorbing and retaining a quantity of developing liquid sufficient to provide a reservoir which will feed and supply liquid through the face 30 in pressure contact with the applicator roller 12. It will be appreciated that the surface 14 of the roller is capable of carrying a quantity of liquid and at the point of application, that is prior to the zone 20, the amount of liquid deposited is in excess of the amount that is required to be delivered to the zone 22.

The core 32 is comprised of a compressed layer of absorbant fibers which are advantageously polyester fibers, such as: polybutylene terephthalate, sold by DuPont; polyethylene terephthalate/isophthalate copolymer, sold by DuPont; poly[ethylene glycol, co-bis-hydroxy ethoxy phenyl propane] terephthalate, sold by Eastman Kodak Company. The preferred fibers are formed from polyethylene glycol terephthalate resin known by the trade name "TERYLENE" marketed by the Imperial Chemical Industries. These fibers may be aggregated and compressed into a matted pad. In order to form a more secure matting which will retain its integrity, the pad may be processed by a technique known as needling which involves running special needles with projecting barbs through the matted layers causing entanglement of the fibers throughout the successive layers in a direction transverse to the layers which form the mat. It will be appreciated that the technique of needling is optional, and that the matting formed by ordinary techniques of compression work to equal advantage.

The mat of aggregated and assembled fibers making up the core 32 may optionally include a reinforcing liquid permeable element 34 in order to provide rigidity to the L shaped form. The element 34 may be a metal screen.

The following is a typical example of a mat which may be formed into the fluid delivery wick 24 of the instant invention:

| | |
|---|---|
| Material: | 100% TERYLENE fiber felt — needled. |
| Weight: | 2,000 grams per square meter, ± 5% |
| Thickness: | 10 mm. ± 5% |
| Tensile Strength (machine direction): | 53 kgs. per square meter, ± 5% |
| Elongation (machine direction): | 93% ± 5% |
| Tensile Strength (transverse direction): | 107.4 kgs. per square centimeter ± 5% |
| Elongation (transverse direction): | 46% ± 5% |
| Air flow resistance (porosity): | 2 mm. of water gauge for a flow of air of 2 meters$^3$ per meters$^2$ per minute and for a mat thickness of 10 mm. |

The said tests were carried out on samples of 50 mm. by 250 mm. by 10 mm.; the speed of application of the load amounted to 25 mm. per minute. The tensometer equipment was the W "Monsanto" type; and the temperature at which the tests were conducted was 23°C. and the relative humidity 50%. The terms machine direction and transverse direction refer to the direction of the material on the machine during formation and are conventional terms used in the paper and pulp industry.

It might be mentioned that another physical property of the mat material that may be advantageously used is the residue left after combustion which is in the range of 46 to 48% of the initial weight.

As another test that may be carried out to determine the capillary action of the material is the amount of water absorption into a sample whose size is 50 by 50 by 10 mm. as the result of floating on water. It was noted that such a sample was completely submerged after an elapsed time of 20.5 seconds after floatation began.

With respect to the thickness requirement of a suitable wick, it will be appreciated that this dimension is not critical only that it be of a sufficient dimension to provide the proper rigidity and be of sufficient bulk to hold and deliver a sufficient amount of fluid when the apparatus is operated at a high speed. It has been found that under average operating conditions, the wick may be between 8 and 15 mm. and can vary from these dimensions depending on the size and construction of the apparatus.

Another important aspect of the construction of the fluid delivery wick 24 is the protective covering or sheath 36 which is applied over the core 32. The function of the sheath is to contain the fibrous material that may be loosened during fabrication or otherwise dislodged by the absorption of the liquid. Clearly, the sheath must possess all of the properties of the core with respect to its capacity for absorbing and diffusing developing liquid and, in addition, provide the necessary surface characteristics that contribute to a uniform wiping or application of the liquid to the surface 14 without presenting an undue amount of friction. It will be appreciated that whether the sheath completely covers the core or only a partial covering is employed, such a sheath, whenever it has become worn or damaged, may be removed and replaced. This, of course, reduces the cost of maintaining the fluid delivery wick 24 in good operating condition.

One of the materials that has been found to be eminently successful as such a sheath is comprised of velvet, or, as the case may be, of a fabric having properties substantially similar as regards the coefficient of friction, porosity, permeability and resistance to wear to that of velvet. As regards the last of these properties, it is significant that coating particles, such as fiber elements, shall not be dislodged from such a sheath material.

As shown in FIG. 1, the core 32 is completely covered by the sheath 36. It is to be understood that while this insures a better containment of the core minimizing the contamination due to possible disintegration of the outer face of the mat, all the advantages of such a protective sheath may be realized by only partially covering the upper leg portion 28 of the wick 24, and, in particular, interposing such a sheath at the working face 30 leaving the rest of the core unprotected.

Concerning the matter of the force of friction, it is desired that the sheath 36 be comprised of material with a fairly low coefficient of friction. For example, when measuring the coefficient of friction between velvet and the rubber material of which the applicator roll is formed, it was found that the coefficient should have a value less than 0.7.

The wick 24 is disposed within a tank 38 for containing the developing liquid 40 and is disposed adjacent and below the applicator roller 12. The tank 38 is formed of wall portions 39 sloping outwardly from the floor 41. It will be understood that the longitudinal dimension of the wick is coextensive the length of the applicator roller. The working surface 30 is brought into contacting relationship with the surface 14 of the roller, thereby providing a fairly narrow and restrictive area as compared to the circumference of the roller.

The wick is disposed inside the tank 38 so that the leg portion 28 conforms to the surface of the sloping wall 39 with the base portion 26 resting on the floor 41 of the tank.

In order to adjustably secure the L shaped wick in its operating position adjacent and directly underneath the roller, there is provided a clamping plate 44 having an opening 46 in the face thereof through which is received a sleeve 48 having an internal thread and which is adapted to be received on a male threaded portion 49 secured in the sloping wall portion 39 directly in line with said opening 46.

Figure 2:
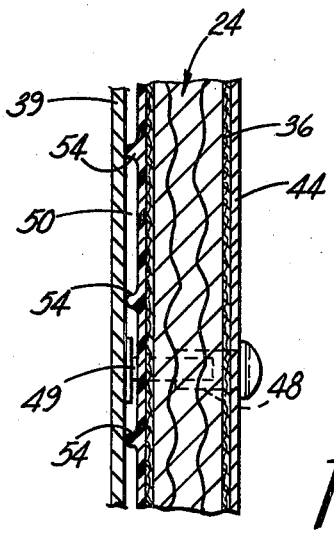
FIG. 2 is a cross-section taken along lines 2—2 in FIG. 1.

As part of the wick support structure, there is employed a spacer plate 50 in order to maintain a gap between the fluid delivery wick 24 and the wall 39 in order that there be provided a channel for excess liquid 52 falling from the surface 14 of the applicator roller 12. In this manner, the dripping liquid will be directed back into the tank 38. Such a spacer plate 50 is equipped with vertical rib members 54 (FIG. 2) providing a space between the wall 39 and the back surface of the wick 24.

To further assure proper positioning of the wick 24 within the tank 38, there is provided a channel 56 which is affixed to the floor 41 of the tank and is adapted to receive the base portion 26 thereby establishing a lower limiting position for the wick 24 within the tank and submerged below the level of liquid 40.

The aforedescribed support arrangement permits the leg portion 28 to be captured between the spacer plate 50 and the clamping plate 44 securing the wick 24 on the inside of the wall 39 by merely threading the sleeve onto the male threaded portion 49. Understandably, fibrous resin materials which are used to form the construction will result in some dimensional variations necessitating that the wick be adjusted to bring the working face 30 into intimate contact with the surface of the roller. By loosening the sleeve 48, the entire wick structure may be adjusted relative to the clamping plate 44 and the spacer plate 50 by virtue of the enlarged opening 58 which extends through the thickness of the wick permitting a certain amount of lowering or raising of its position within the tank.

It is to be understood that the invention is not limited to the embodiment herein described, and that many modified forms may be considered without departing from the scope of the present invention.

What is claimed is:

1. In a developing apparatus for developing two-component diazotype materials by the application thereto of a controlled amount of liquid developer comprising an applicator roller, means for metering an excess amount of liquid carried on said applicator roller to establish a metered liquid zone thereon, and liquid supply means for applying said excess amount of liquid to the applicator roller and recovering any excess liquid, the improvement comprising:

a reservoir having a floor and a wall portion adjacent said applicator roller for holding a supply of said liquid;

a liquid supply element partially immersed in said reservoir comprising a core of fibrous matted material capable of absorbing said developing liquid, at least a portion of said core being arranged to contact the applicator roller, and a sheath of porous, liquid absorbing material enclosing at least that portion of the core arranged to contact said applicator roller; and clamping means for securing said liquid supply element in an upstanding condition against said wall portion including a spacer means disposed between the wall portion and said supply element forming a channel therebetween for guiding any liquid flowing from said applicator roller in advance of said liquid supply means for collecting and directing said recovered liquid into said reservoir.

2. The developing apparatus as claimed in claim 1 wherein said liquid supply element is L shaped having a foot section and leg portion wherein said foot section resides against restraining means on the floor of said reservoir.

3. The developing apparatus as claimed in claim 1 wherein said spacer means includes vertically extending ribs for maintaining said spacer means in spaced relation to said wall portion.

4. In a developing apparatus for developing two-component diazotype material by the application thereto of a controlled amount of liquid developer comprising an applicator roller, means for metering an excess amount of liquid carried on said applicator roller to establish a metered liquid zone thereon and liquid supply means for applying said excess amount of liquid, the improvement comprising:

a liquid supply element comprising a core of fibrous matted material having the following physical properties:

| | |
|---|---|
| WEIGHT: | 2,000 grams per sq. M ± 5% |
| TENSILE STRENGTH (machine direction): | 53 kgs. per sq. M ± 5% |
| ELONGATION (machine direction): | 93% ± 5% |
| TENSILE STRENGTH (transverse direction): | 107.4 kgs. per sq. m. ± 5% |
| ELONGATION (transverse direction): | 46% ± 5% |
| AIR FLOW RESISTANCE: | 2 mm. of water gauge for an air flow of 2 $m^3/m^2/min.$ through a 10 mm. layer thickness. |

* * * * *